US010903602B2

(12) United States Patent
Huang

(10) Patent No.: US 10,903,602 B2
(45) **Date of Patent: *Jan. 26, 2021**

(54) COAXIAL CABLE CONNECTOR

(71) Applicant: EZCONN CORPORATION, New Taipei (TW)

(72) Inventor: Kai wei Huang, New Taipei (TW)

(73) Assignee: EZconn Corporation, Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 16/781,002

(22) Filed: Feb. 4, 2020

(65) Prior Publication Data

US 2020/0176927 A1 Jun. 4, 2020

Related U.S. Application Data

(63) Continuation of application No. 15/954,612, filed on Apr. 17, 2018, now Pat. No. 10,594,076.

(60) Provisional application No. 62/486,472, filed on Apr. 18, 2017.

(51) Int. Cl.

| | |
|---|---|
| ***H01R 9/05*** | (2006.01) |
| ***H01R 13/622*** | (2006.01) |
| ***H01R 13/623*** | (2006.01) |
| ***H01B 11/18*** | (2006.01) |
| *H01R 24/40* | (2011.01) |
| *H01R 103/00* | (2006.01) |

(52) U.S. Cl.

CPC ..... *H01R 13/622* (2013.01); *H01B 11/1804* (2013.01); *H01B 11/1869* (2013.01); *H01R 9/0521* (2013.01); *H01R 9/0524* (2013.01); *H01R 24/40* (2013.01); *H01R 2103/00* (2013.01)

(58) Field of Classification Search

CPC .. H01R 13/622; H01R 9/0521; H01R 9/0524; H01R 24/40; H01R 2103/00; H01B 11/1804; H01B 11/1869

See application file for complete search history.

(56) References Cited

U.S. PATENT DOCUMENTS

| | | | | |
|---|---|---|---|---|
| 2015/0333419 | A1* | 11/2015 | Eriksen | H01R 13/502 439/578 |
| 2016/0072204 | A1* | 3/2016 | Edmonds | H01R 13/502 439/583 |
| 2016/0322751 | A1* | 11/2016 | Van Swearingen | H01R 13/642 |
| 2018/0054017 | A1* | 2/2018 | Watkins | H01R 13/622 |
| 2018/0131143 | A1* | 5/2018 | Balcer | H01R 9/0524 |

* cited by examiner

*Primary Examiner* — Edwin A. Leon
*Assistant Examiner* — Milagros Jeancharles

(57) ABSTRACT

A coaxial cable connector comprises: an inner sleeve having a first outer flange and a first surface; a nut coaxially arranged with the inner sleeve, comprising a first inner flange and a threaded portion, the threaded portion of the nut engages with a threaded surface of a connector of an electronic device; a first inner ring coaxially arranged with the inner sleeve, comprising a ring portion and a plurality of elastic portions, one end of each of the plurality of elastic portions comprising a second outer flange disposed between the ring portion and the first outer flange; and an outer sleeve coaxially arranged with the first inner ring and the inner sleeve, wherein when the outer sleeve moves toward the nut, an engaging bump of the outer sleeve presses the second outer flange to enable the second outer flange to move toward the outer surface of the inner sleeve.

12 Claims, 5 Drawing Sheets

COAXIAL CABLE CONNECTOR

RELATED APPLICATION

The present application is a continuation application of U.S. nonprovisional application Ser. No. 15/954,612, filed on Apr. 17, 2018, which in turn claims priority to U.S. provisional application Ser. No. 62/486,472, filed on Apr. 18, 2017, each of which is hereby incorporated by reference in its entirety.

BACKGROUND OF THE INVENTION

Field of the Invention

The present invention relates to a coaxial cable connector, and more particularly, to a coaxial cable connector having high tensile strength.

Brief Description of the Related Art

The signal connector generally refers to the connecting elements and their accessories for connecting with the electronic signals and power signals, functioning as a bridge for all signals. The quality of the signal connector will affect the reliability of current and signal transmission and is also closely associated with the operation of the electronic system. As the types of the electronic systems differ, the specifications and structure of the signal connectors will also vary. However, in order for the signal connector to have a favorable "signal transmission stability", many of the state-of-the-art technologies are aimed at improving the existing signal connectors to provide consumers with better products, wherein the coaxial cable carries the cable TV signal to a receiving television. This coaxial cable can be connected to cable TV decoders (cable TV decoders), cassette video recorder/digital disc (VCR/DVD) digital hard disk recorder hard disk digital recorders, satellite receivers, video games, TV signal distribution splitters, and switches via Screw-on F-Type connectors.

In general, most of the coaxial cables use a single-core bare copper wire, a multi-core copper wire, a copper-clad steel wire, or a tin-plated copper wire, etc. as the internal conductor wire. The conductor wire is then surrounded by layers of ring-shaped materials and is covered with an insulating layer, wherein the insulating layer can be made of material such as transparent PE, foamed PE, FB, solid polyester. Also, the insulation layer is covered with a copper braid shield. The copper braid shield is mostly made of braided metal wires such as copper wire or aluminum wire. Lastly, the outer surface of the braided metal wires is covered with a jacket made of plastic materials such as PE, PVC, NC-PVC, LSFH. Since the cross-section of the coaxial cable is concentric, its structure can provide shielding effect for electromagnetic signal carried inside the coaxial cable for preventing external noise interference, which makes the coaxial cable suitable for transmitting high-frequency signals such as video and audio.

The applicant has discovered that there are still problems existed in various coaxial cable connectors and need to be improved. For example, when the user pulls the coaxial cable of the coaxial cable connector, it can easily cause the coaxial cable to loosen up, resulting in unstable transmission of signals. Accordingly, it is an important issue to resolve the foregoing problem in the industry.

SUMMARY OF THE INVENTION

The present invention provides a coaxial cable connector adapted to be mounted to the coaxial cable. The coaxial cable connector is adapted to engage the electronic device which has a joint with a threaded surface. The coaxial cable connector comprises an inner sleeve comprising a first outer flange and a first surface; a nut is coaxially arranged with the inner sleeve, including a first inner flange and a threaded portion, wherein the threaded portion of the nut is adapted to engage the threaded surface; a first inner ring is coaxially arranged with the inner sleeve, wherein the first inner ring comprises a ring portion and a plurality of elastic portions. One end of each of the plurality of elastic portions is respectively connected with the ring portion, and a first gap is formed between each two adjacent elastic portions of the plurality of elastic portions, and the other end of each of the plurality of elastic portions has a second outer flange. The second outer flange is axially disposed between the ring portion and the first outer flange, and a first annular space is formed between the ring portion and a part of the first rear-end extension portion, and an outer sleeve is coaxially arranged with the first inner ring and the inner sleeve. The inner wall of the outer sleeve has a second inner flange and an engaging bump which is in contact with the outer surface of the first inner ring. The engaging bump is axially disposed between the second inner flange and the second outer flange. When the outer sleeve moves axially toward the nut, the engaging bump can press the second outer flange, so that the second outer flange is moved radially toward the outer surface of the inner sleeve.

The present invention provides an inner ring adapted to be mounted to the coaxial cable connector. The coaxial cable connector is adapted to engage the electronic device which has a joint with a threaded surface, wherein the coaxial cable connector comprises an inner sleeve, an outer sleeve coaxially arranged outside the inner sleeve, and an nut coaxially arranged with the inner sleeve, wherein the threaded portion of the nut is adapted to engage the threaded surface, characterized in that: the inner ring comprises a first inner flange, a ring portion, a plurality of elastic portions and a plurality of wings, wherein the first inner flange is fixedly engaged on the inner sleeve and the first inner flange is disposed between the ring portion and the nut, wherein the plurality of wings are disposed between the first inner flange and the plurality of elastic portions, wherein the plurality of elastic portions are respectively disposed between each two adjacent wings of the plurality of wings, wherein one end of each of the plurality of elastic portions is fixedly engaged with the ring portion while the other end of each portion has a first outer flange, and the first outer flange is disposed between the ring portion and the first inner flange, and wherein when the outer sleeve moves toward the nut, the engaging bump of the outer sleeve presses the first outer flange such that the first outer flange moves radially toward the axial of the inner sleeve.

These and other components, steps, features, benefits, and advantages of the present invention will now be apparent from the following description of illustrative embodiments, the accompanying drawings, and the detailed description of the claims.

Figure 1:
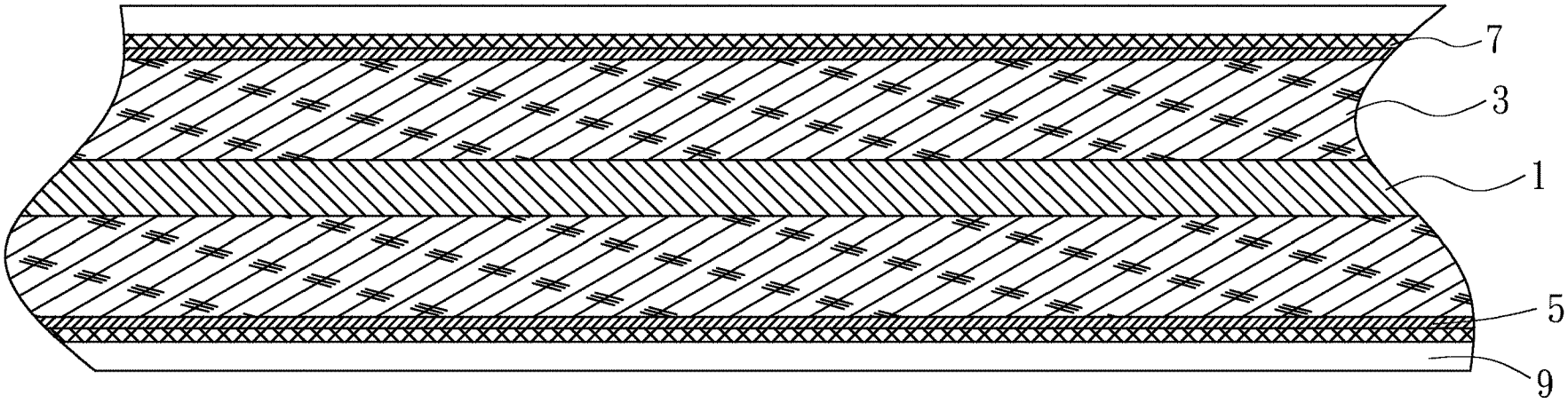
FIG. 1 is a cross-sectional view of a coaxial cable according to one embodiment of the present invention.
Figure 2B:
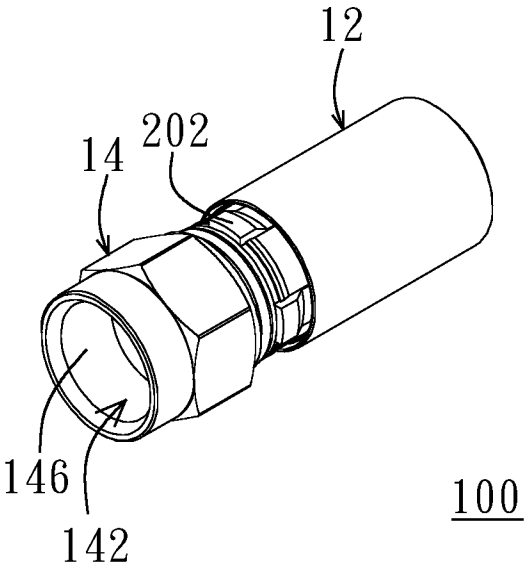
FIG. 2B is a 3D view of the coaxial cable connector according to one embodiment of the present invention.
Figure 2A:
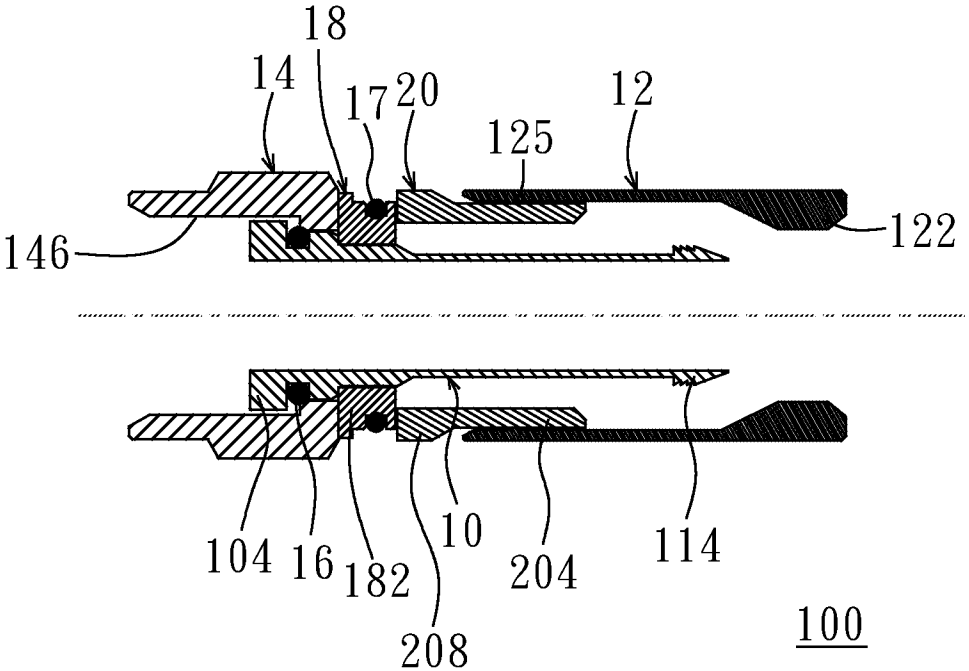
FIG. 2A is a cross-sectional view of a coaxial cable connector according to one embodiment of the present invention.
Figure 3A:
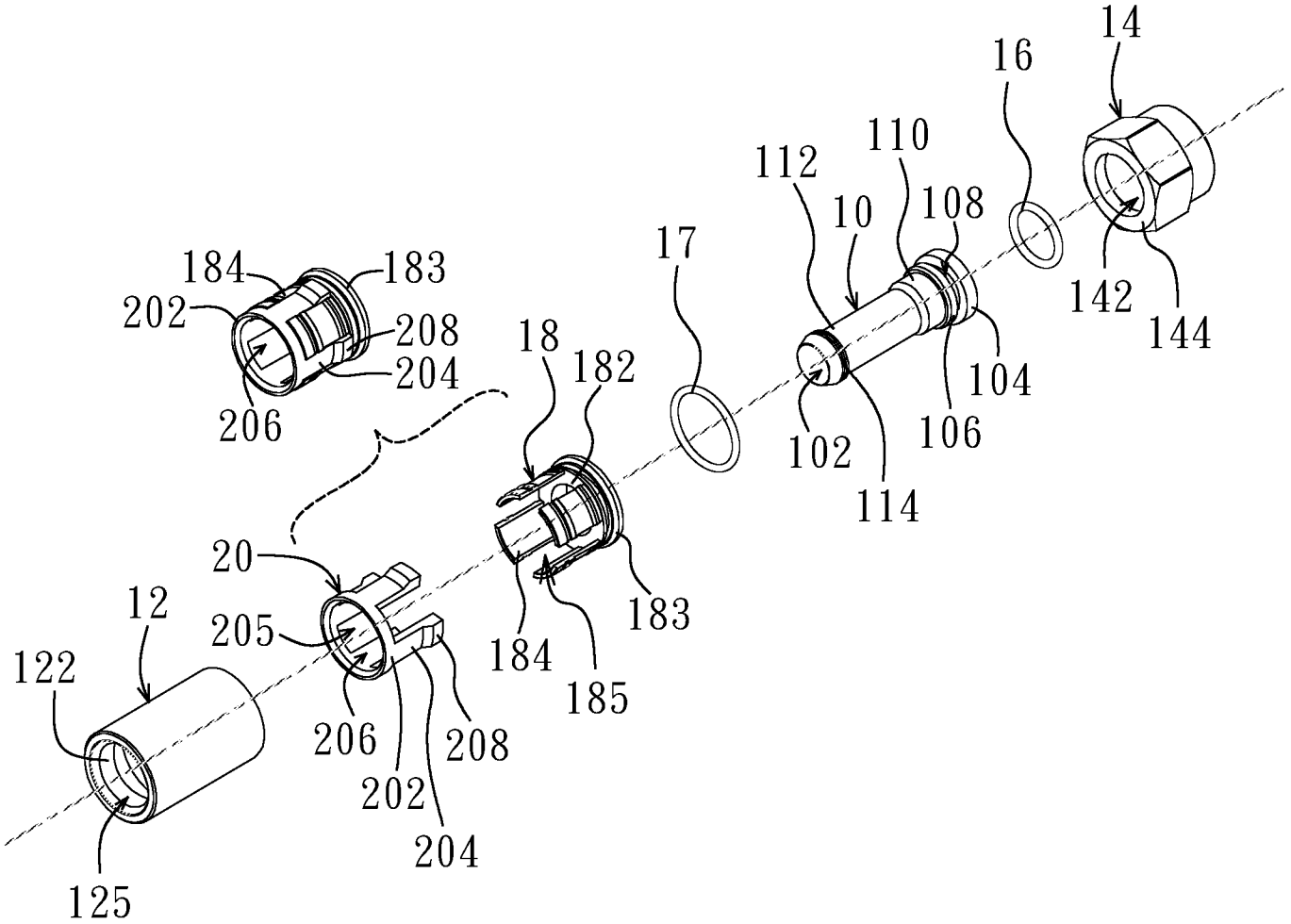
FIG. 3A is a 3D exploded view of the for the coaxial cable connector according to one embodiment of the present invention.
Figure 3B:
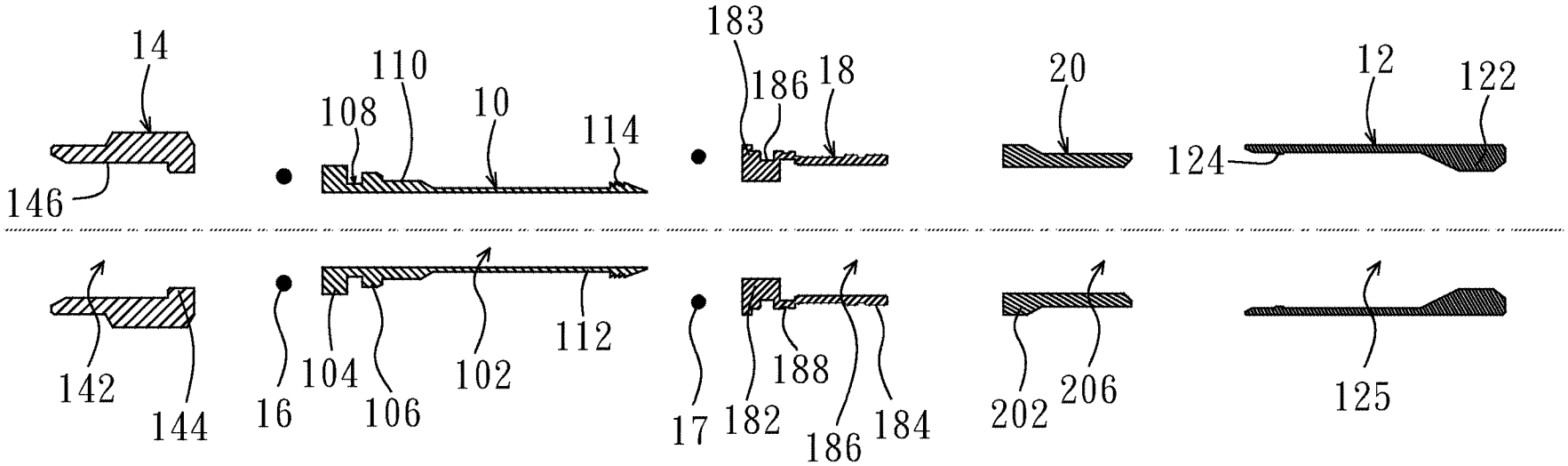
FIG. 3B is an exploded cross-sectional view of a coaxial cable according to one embodiment of the present invention.

While certain embodiments are depicted in the drawings, one skilled in the art will appreciate that the embodiments depicted are illustrative and that variations of those shown, as well as other embodiments described herein, may be envisioned and practiced within the scope of the present invention.

DETAILED DESCRIPTION OF THE INVENTION

The drawings disclose illustrative embodiments of the present invention. They do not set forth all embodiments. Other embodiments may be used in addition or instead. Details that may be apparent or unnecessary may be omitted to save space or for more effective illustration. Conversely, some embodiments may be practiced without all of the details that are disclosed. When the same numeral appears in different drawings, it refers to the same or similar components or steps.

The present invention will become more fully understood from the detailed description given herein below and the accompanying drawings which are given by way of illustration only, and thus are not to be considered as limiting the present invention. The drawings are not necessarily drawn to scale, emphasis instead being placed on the principles of the present invention.

Illustrative embodiments are now described. Other embodiments may be used in addition or instead. Details that may be apparent or unnecessary may be omitted to save space or for a more effective presentation. Conversely, some embodiments may be practiced without all of the details that are disclosed.

The present invention provides a coaxial cable connector, wherein the coaxial cable connector, as shown in the cross-sectional view in FIG. 1, includes a metal wire 1, an insulating layer 3 enclosing the metal wire 1, a metal film 5 enclosing the insulating layer 3, a braided metal layer 7 enclosing the metal film 5, and a plastic jacket 9 enclosing the braided metal layer 7, wherein the metal wire 1 may be made of copper, iron, silver, nickel, tin, gold, a copper-gold alloy, a copper-tin alloy, a copper-nickel alloy, other polymers with favorable conductivity or a non-metal conductor or the like. Furthermore, the metal film 5 may be made of an aluminum-containing film, copper-containing film, or conductive film, such as aluminum or copper foil, wherein the metal film 5 has an electrical shielding effect to reduce electrical interference. The braided metal layer 7 may be made of two, three or four layers of braided metal, such as aluminum, an aluminum alloy, copper or a copper alloy.

Please refer to FIGS. 2A, 2B, 3A and 3B, which in sequence are the cross-sectional view, the 3D view, the 3D exploded view and the exploded cross-sectional view of the present invention. The coaxial cable connector 100 may include an inner sleeve 10, an outer sleeve 12, a nut 14, a first rubber ring 16, a second rubber ring 17, a first inner ring 18 and a second inner ring 20. The inner sleeve 10, the outer sleeve 12, the first inner ring 18 and the nut 14 may be made of a conductive material, such as copper, iron, silver, nickel, tin, gold, a copper-gold alloy, a copper-tin alloy, other polymers with favorable conductivity or a non-metal conductor. Also, the surfaces of the inner sleeve 10, the outer sleeve 12, the first inner ring 18 and the nut 14 may be covered with a rust-proof metal layer made of such material as copper, iron, silver, nickel, tin, gold, a copper-gold alloy, a copper-tin alloy, other polymers with favorable conductivity or a non-metal conductor, by an electroplating or electroless plating process. Additionally, the rubber ring 16 is made of rubber material, but may be replaced with other flexible and waterproof polymer material.

The inner sleeve 10 of the present invention has a through hole 102, a first outer flange 104, a second outer flange 106, a first groove 108, a first surface 110 and a first rear-end extension portion 112, wherein the first groove 118 is disposed between the first outer flange 104 and the second outer flange 106, the first surface 110 is located between and the second outer flange 106 and first rear-end extension portion 112. In addition, there is a third outer flange 114 on first rear-end extension portion 112. The third outer flange 114 may include a zigzag-shaped protrusion. The first rubber ring 16 may be annularly disposed within the first groove 108.

The nut 14 of the present invention has a first inner flange 144 and a thread portion 146, wherein the nut 14 may be a hexagonal nut, square nut, ring nut or wing nut that can be used to lock the connector to an electronic device using a wrench or other tool. The first inner flange 144 has a through hole 142 therebetween. The first rear-end extension portion 112 of the inner sleeve 10 may pass through the through hole 142 of the nut 14 such that the first inner flange 144 of the nut 14 is disposed on the second outer flange 106 and partially located in the first groove 108 as well as in contact with the first rubber ring 16. The nut 14 can be rotated and moved back and forth on the second outer flange 106 and the first groove 108. When the first inner flange 144 of the nut 14 moves toward the first groove 108, the first inner flange 144 presses the first rubber ring 16 to deform. The gap between the first inner flange 144 and the first groove 108 can be filled by the rubber ring 16 to attain the waterproof effect.

The first inner ring 18 of the present invention comprises a second inner flange 182, a plurality of wings 184 and a fourth outer flange 183 which are integrally formed. A through hole 186 is axially formed along a center line of the second inner flange 182, the fourth outer flange 183 is disposed on a surface of the second inner flange 182, and a second groove 186 is annularly disposed on the second inner flange 182. One end of each of the plurality of wings 184 is disposed in the lateral side of the second inner flange 182 and a gap 185 is between each two adjacent wings 184 of the plurality of wings 184, and a third groove 188 is disposed on the edge of each wing 184 near a side surface connecting the second inner flange 182, the depth of the third groove 188 is smaller than that of the second groove 186. The inner sleeve 10 is passed through the through hole 186 of the first inner ring 18 via the first rear-end extension portion 112 which is coaxially arranged with the first surface 110 of the inner sleeve 10 in a tight-fitting manner such that a lower surface of the second inner flange 182 is radially engaged and tightly fixed with the first surface 110 of the inner sleeve 10. A second rubber ring 17 can be annularly disposed within the second groove 186.

The second inner ring 20 of the present invention comprises a ring portion 202 and a plurality of elastic portions 204 which are integrally formed. A through hole 206 is axially formed along a center line of the ring portion 202, one end of each of the plurality of elastic portions 204 is disposed on a side surface of the ring portion 202, a gap 205 is formed between each two adjacent elastic portions 204 of the plurality of elastic portions 204, and a fifth outer flange 208 is disposed on the other end of each of the plurality of elastic portions 204. The inner sleeve 10 is passed through the through hole 206 of the second inner ring 20 via the first rear-end extension portion 112, wherein each of the plurality of elastic portions 204 is inserted into the gap 185 of the first inner ring 18 such that one end of each of the plurality of elastic portions 204 is abutted on a side surface of the second inner flange 182 of the first inner ring 18, and wherein the plurality of wings 184 of the first inner ring 18 are respectively inserted into the corresponding gap 205 of the second inner ring 20 such that one end of each of the plurality of wings 184 is abutted on a side surface of the ring portion 202 of the second inner ring 20. In this way, the second inner ring 20 and the first inner ring 18 form a circumferential surface via the mutual engagement of the plurality of elastic portions 204 and the plurality wings 184 in the circumferential direction, respectively. A concentric annular space is formed between a part of the first rear-end extension portion 112 and the circumferential surface formed by the plurality elastic portions 204 and the plurality of wings 184. In addition, one end of the fifth outer flange 208 of each of the plurality of elastic portions 204 can move up and down radially in the gap 185 of the first inner ring 18. The fifth outer flange 208 on each of the plurality of elastic portions 204 is protruded out of outer arc surfaces on both of each of the plurality elastic portions 204 and each of the plurality wings 184, i.e. the diameter of the top end surface of the fifth outer flange 208 is greater than the diameters of the outer surfaces on both of each of the plurality of elastic portions 204 and each of the plurality wings 184. Further, the first inner ring 18 and the second inner ring 20 can also be integrally formed into a metal inner sleeve (not shown), which comprises the plurality of elastic portions 204, the plurality of wings 184, the second inner flange 182 and the ring portion 202. The plurality of wings 184 are respectively connected with the second inner flange 182 and the ring portion 202, and the plurality of elastic portions 204 are respectively disposed between the corresponding each two adjacent wings 184 of the plurality of wings 184.

The outer sleeve 12 of the present invention has a fourth inner flange 122, an engaging bump 124, and a through hole 125, wherein the fourth inner flange 122 is disposed at one end of the outer sleeve 12, which is defined as a rear end of the outer sleeve 12, and the engaging bump 124 is annularly disposed an inner wall close to the other end of the outer sleeve 12, which is defined as a front end of the outer sleeve 12. The first rear-end extension portion 112 of the inner sleeve 10 is passed through the through hole 125 of the front end of the outer sleeve 12, and the inner wall of the front end of the outer sleeve 12 can contact with the circumferential surface formed by the plurality of elastic portions 204 and the plurality of wings 184. When the outer sleeve 12 continues to move toward the direction of a nut 14, the front end of the outer sleeve 12 is abutted on an inclined surface of the fifth outer flange 208 on each of the plurality of elastic portions 204 such that the fifth outer flange 208 moves radially (i.e., up and down) toward the axial direction of the circumferential surface, namely, to move axially toward the center line or outer surface of the inner sleeve 10. While the outer sleeve 12 continues to move toward the nut 14, the engaging bump 124 of the outer sleeve 12 is abutted on a top end surface of the fifth outer flange 208. While the outer sleeve 12 further continues to move toward the nut 14, the engaging bump 124 is latched in the third groove 188 on the outer surface of the first inner ring 18. Meanwhile, the front end of the outer sleeve 12 is abutted on the fourth outer flange 183 of the first inner ring 18, at this time the fourth inner flange 122 fully surrounds the first rear-end extension portion 112 of the inner sleeve 10, and a concentric annular space between the inner wall of the outer sleeve 12 and the first rear-end extension portion 112 of the inner sleeve 10 is formed, wherein the radial distance between the inner wall of the outer sleeve 12 and the outer surface of the first rear-end extension portion 112 of the inner sleeve 10 is greater than the radial distance between the inner wall of the second inner ring 20 and the outer surface of the first rear-end extension portion 112 of the inner sleeve 10.

Figure 4A:
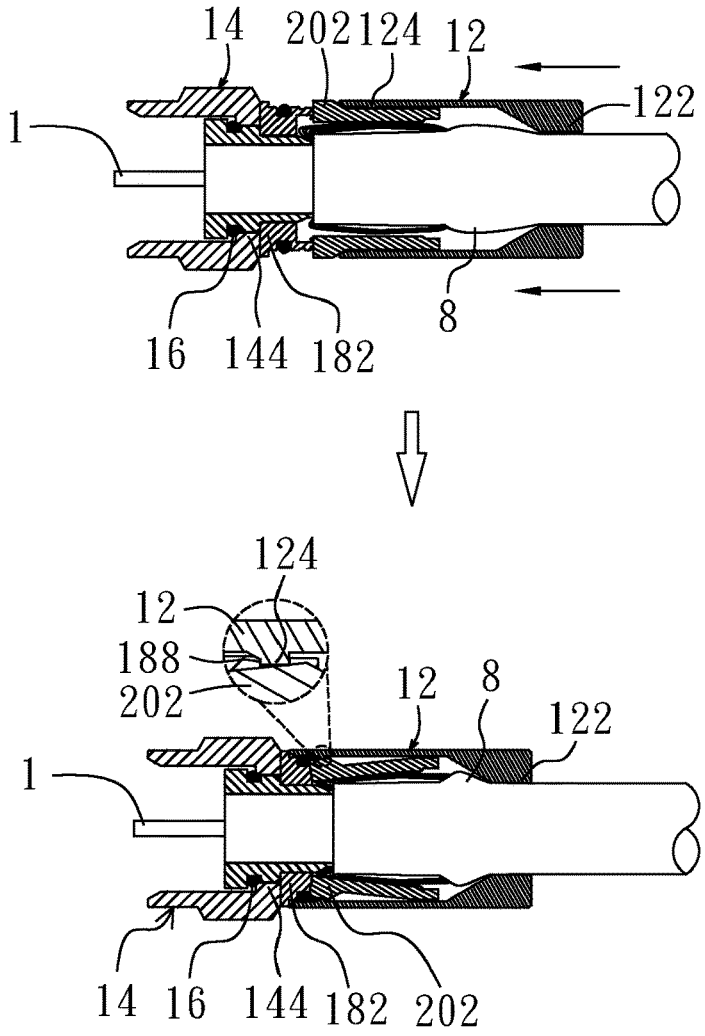
FIG. 4A is a schematic cross-sectional view showing the coaxial cable connector assembled with the coaxial cable according to one embodiment of the present invention.
Figure 4B:
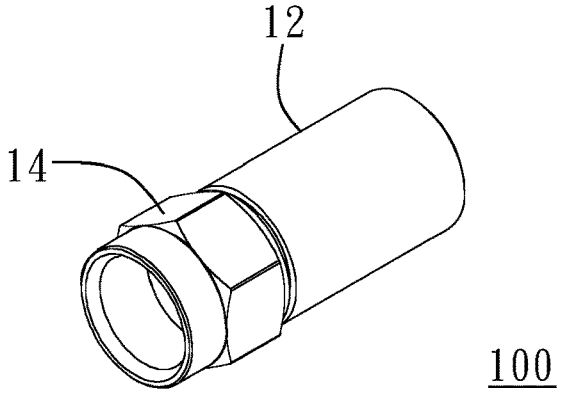
FIG. 4B is another 3D view of the coaxial cable connector according to one embodiment of the present invention.

As shown in FIG. 4A and FIG. 4B, the assembly procedures of the coaxial cable connector 100 of the present invention and the coaxial cable is first to assemble the inner sleeve 10, the outer sleeve 12, the nut 14, the first rubber ring 16, the second rubber ring 17, the first inner ring 18 and the second inner ring 20, then the coaxial cable is mounted to the coaxial cable connector 100. Specifically, the assembly procedures consist of annularly disposing the first rubber ring 16 within the first groove 108, then passing the first rear-end extension portion 112 of the inner sleeve 10 through the through hole 142 of the nut 14 such that the first inner flange 144 of the nut 14 is disposed on the second outer flange 106, and positioning a part of the first inner flange 144 on the first groove 108 in contact with the first rubber ring 16, then annularly disposing the second rubber ring 17 on the second groove 186 of the first inner ring 18, and then passing the first rear-end extension portion 112 of the inner sleeve 10 through the through hole 186 of the first inner ring 18 and coaxially arranging it with the first surface 110 of the inner sleeve 10 in a tight-fitting manner, and further passing the first rear-end extension portion 112 of the inner sleeve 10 through the through hole 206 of the second inner ring 20, wherein each of the plurality of elastic portions 204 is inserted into the gap 185 of the first inner ring 18 such that one end of each of the plurality of elastic portions 204 is abutted on the side surface of the second inner flange 182 of the first inner ring 18, and wherein each of the plurality of wings 184 of the first inner ring 18 is inserted into the gap 205 of the second inner ring 20 such that one end of each of the plurality of wings 184 is abutted on the side surface of the ring portion 202 of the second inner ring 20, and then passing the first rear-end extension portion 112 of the inner sleeve 10 through the through hole 125 from the front end of the outer sleeve 12, wherein the inner wall at the front end of the outer sleeve 12 is in contact with the circumferential surface formed by the plurality elastic portions 204 and the plurality wings 184, then removing a part of the plastic layer 9 of the coaxial cable so that a part of the braided metal layer 7 covers partial outer surface of the plastic layer 9, and then passing the coaxial cable through the coaxial cable connector 100, wherein the braided metal layer 7 and the plastic layer 9 of the coaxial cable are extruded into an annular space formed between the first rear-end extension portion 112 of the inner sleeve 10 and the outer sleeve 12, and extruded into an annular space formed between the first rear-end extension portion 112 and the circumferential surface formed by the plurality elastic portions 204 and the plurality of wings 184. Further, a metal wire 1, an insulating layer 3 and a thin metal layer 5 of the coaxial cable are inserted into the inner sleeve 10 from a rear end to a front end of the through hole 102, wherein the metal wire 1 extends to a space formed by the threaded portion 146 of the nut 14, and wherein the first rear-end extension portion 112 of the inner sleeve 10 is inserted between the braided metal layer 7 and the plastic layer 9, and wherein a third outer flange 114 on the first rear-end extension portion 112 can open the plastic layer 9 to form a plastic bump 8 in an annular space formed between the first rear-end extension portion 112 of the inner sleeve 10 and the outer sleeve 12.

Continuing to force the outer sleeve 12 to move toward the nut 14, the front end of the outer sleeve 12 is abutted on an inclined surface of the fifth outer flange 208 on the plurality of elastic portions 204, at this time the fifth outer flange 208 begins to move radially toward the axial direction of the circumferential surface (i.e., up and down). The outer sleeve 12 further continues to move toward the nut 14, and the engaging bump 124 of the outer sleeve 12 is abutted on a top end surface of the fifth outer flange 208 until the engaging bump 124 is latched in the third groove 188 on the outer surface of the first inner ring 18. Meanwhile, the front end of the outer sleeve 12 is abutted on the fourth outer flange 183 of the first inner ring 18, at this moment, the bottom of the fifth outer flange 208 presses and locks the braided metal layer 7 and the plastic layer 9 disposed between first rear-end extension portion 112 and the circumferential surface formed by the plurality of elastic portions 204 and the plurality of wings 184 such that the coaxial cable is tightly bonded to the coaxial cable connector 100. At the same time, the fourth inner flange 122 of the outer sleeve 12 is abutted on the plastic bump 8 such that the coaxial cable is more fixed with the coaxial cable connector 100, and thus the coaxial cable is not easy to fall off.

Though the embodiments of the present invention have been shown and described, it will be understood by those skilled in the art that such embodiments can be varied without departing from the principles and spirit of the present invention. The scope of the present invention is defined by the appended claims and their equivalents. The scope of protection of the present invention shall be defined as the scope of the patent application as claimed. It should be noted that the term "include" does not exclude other elements, and the term "one" does not exclude plurality.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

What is claimed is:

1. A coaxial cable connector for connecting a coaxial cable, said coaxial cable connector is adapted to engage with a connector of an electronic device having a threaded surface, said coaxial cable connector comprising:

an inner sleeve, comprising a first outer flange, a second outer flange and a first rear-end extension portion having a third outer flange thereon opposite the first outer flange, wherein the second outer flange is disposed between the first outer flange and third outer flange;

a nut, coaxially arranged with the inner sleeve, comprising a first inner flange and a threaded portion adapted to engage with said threaded surface, wherein the first inner flange is positioned on the second outer flange of the inner sleeve;

a second inner ring, coaxially arranged with the inner sleeve, comprising a ring portion and a plurality of elastic portions, wherein one end of each of the plurality of elastic portions is respectively connected with said ring portion, and a first gap is formed between each two adjacent elastic portions of the plurality of elastic portions, and the other end of each of the plurality of elastic portions comprises a fifth outer flange;

a first inner ring, coaxially arranged with an outer surface of the inner sleeve, comprising a third groove thereon, a second inner flange and a plurality of wings integrally formed therewith, wherein one end of each of the plurality of wings is respectively connected to the second inner flange, and a second gap is formed between each two adjacent wings of the plurality of wings, and wherein the other end of each of the plurality of wings is respectively inserted into the first gaps between each two adjacent elastic portions of the plurality of elastic portions; and an outer sleeve coaxially arranged with the second inner ring and the inner sleeve, wherein an inner wall of the outer sleeve comprises a fourth inner flange and an engaging bump, wherein the engaging bump is in contact with an outer surface of the second inner ring and is positioned between the second outer flange of the inner sleeve and the fifth outer flange of the second inner ring, wherein the ring portion of the second inner ring is positioned between the second and third outer flanges of the inner sleeve, and wherein a first annular space is formed between the ring portion and a part of the first rear-end extension portion, wherein when the outer sleeve moves toward the nut, the engaging bump presses the fifth outer flange of the second inner ring so as to enable the fifth outer flange to axially move toward the outer surface of the inner sleeve and latch in the third groove of an outer surface of the first inner ring, and wherein an amount of said plurality of elastic portions is two or greater and an amount of said plurality of wings is two or greater.

2. The coaxial cable connector according to claim 1, wherein said ring portion and said plurality of elastic portions are integrally formed.

3. The coaxial cable connector according to claim 1, wherein when the coaxial cable is mounted on the coaxial cable connector, the coaxial cable forms a plastic bump in a second annular space between the inner wall of the outer sleeve and the outer surface of the inner sleeve, and the fourth inner flange of the outer sleeve abuts against the plastic bump.

4. The coaxial cable connector according to claim 1, wherein when the coaxial cable is mounted on the coaxial cable connector and the outer sleeve axially moves toward the nut, the engaging bump presses the fifth outer flange so as to enable the fifth outer flange to press the coaxial cable from opposing directions.

5. The coaxial cable connector according to claim 1, wherein the inner sleeve further comprises a first groove disposed between the first outer flange and the second outer flange so as to coaxially arrange with a rubber ring.

6. The coaxial cable connector according to claim 1, wherein the outer surface of the first inner ring further comprises a second groove for so as to coaxially arrange with a rubber ring.

7. An inner ring, adapted for assembly to a coaxial cable connector, said coaxial cable connector is adapted to engage with a connector of an electronic device having a threaded surface, comprising:

a second inner ring; and a first inner ring, wherein the coaxial cable connector comprises an inner sleeve having a first outer flange, and a second outer flange, an outer sleeve coaxially arranged outside of the inner sleeve, having a fourth inner flange and an engaging bump, wherein the engaging bump is positioned between the second outer flange of the inner sleeve and the fifth outer flange of the second inner ring, and a nut coaxially arranged with the inner sleeve, wherein the threaded portion of the nut is adapted to engage with the threaded surface of the connector of the electronic device, wherein the second inner ring, coaxially arranged with the inner sleeve, comprises a ring portion and a plurality of elastic portions, wherein one end of each of the plurality of elastic portions is respectively connected with said ring portion, and a first gap is formed between each two adjacent elastic portions of the plurality of elastic portions, and the other end of each of the plurality of elastic portions comprises a fifth outer flange; and wherein the first inner ring, coaxially arranged with an outer surface of the inner sleeve, comprises a second inner flange and a plurality of wings integrally formed therewith, wherein one end of each of the plurality of wings is respectively connected to the second inner flange, and a second gap is formed between each two adjacent wings of the plurality of wings, and wherein the other end of each of the plurality of wings is respectively inserted into the first gaps between each two adjacent elastic portions of the plurality of elastic portions, wherein when the outer sleeve moves toward the nut, the engaging bump presses the fifth outer flange of the second inner ring so as to enable the fifth outer flange to axially move toward the outer surface of the inner sleeve, and wherein an amount of said plurality of elastic portions is two or greater and an amount of said plurality of wings is two or greater.

8. The inner ring according to claim 7, wherein the inner ring is made of a material comprising polymer.

9. The inner ring according to claim 7, wherein when the coaxial cable is mounted on the coaxial cable connector, the coaxial cable forms a plastic bump in a second annular space between an inner wall of the outer sleeve and the outer surface of the inner sleeve, and the fourth inner flange of the outer sleeve abuts against the plastic bump.

10. The inner ring according to claim 7, wherein the first inner ring further comprises a third groove thereon, wherein when the outer sleeve moves toward the nut, the engaging bump presses the fifth outer flange of the second inner ring to latch in the third groove of an outer surface of the first inner ring.

11. The inner ring according to claim 7, wherein the inner sleeve further comprises a first groove disposed between the first outer flange and the second outer flange so as to coaxially arrange with a rubber ring.

12. The inner ring according to claim 7, wherein an outer surface of the first inner ring further comprises a second groove for so as to coaxially arrange with a rubber ring.

* * * * *